United States Patent [19]

Suzuki et al.

[11] 4,406,536

[45] Sep. 27, 1983

[54] DEVELOPING DEVICE

[75] Inventors: Kohji Suzuki, Yokohama; Toshio Kaneko; Hajime Oyama, both of Tokyo; Shigekazu Enoki, Kawasaki, all of Japan

[73] Assignee: Ricoh Company, Ltd., Japan

[21] Appl. No.: 345,543

[22] Filed: Feb. 3, 1982

[30] Foreign Application Priority Data

| | | | |
|---|---|---|---|
| Feb. 4, 1981 | [JP] | Japan | 56-14407 |
| Feb. 4, 1981 | [JP] | Japan | 56-14408 |
| Feb. 4, 1981 | [JP] | Japan | 56-14409 |
| Feb. 4, 1981 | [JP] | Japan | 56-15434 |
| Feb. 4, 1981 | [JP] | Japan | 56-15435 |
| Feb. 4, 1981 | [JP] | Japan | 56-15436 |

[51] Int. Cl.[3] ..... G03G 15/00; G03G 15/08

[52] U.S. Cl. ..... 355/3 DD; 355/14 D; 118/652; 118/658

[58] Field of Search ..... 355/3 DD, 14 D, 3 R, 355/14 R; 118/651, 652, 653, 656, 657, 658, 639, 640; 430/125

[56] References Cited

U.S. PATENT DOCUMENTS

| | | | |
|---|---|---|---|
| 3,575,139 | 4/1971 | Nuzum | 118/658 |
| 3,641,969 | 2/1972 | Hakanson | 118/658 |
| 4,227,796 | 10/1980 | Kamp et al. | 355/3 DD |
| 4,233,935 | 11/1980 | Vehara et al. | 355/3 DD X |
| 4,237,819 | 12/1980 | Ikegami et al. | 118/657 X |
| 4,265,197 | 5/1981 | Toyono et al. | 355/3 DD X |
| 4,365,586 | 12/1982 | Hosono et al. | 355/3 DD X |

*Primary Examiner*—A. C. Prescott

*Attorney, Agent, or Firm*—Guy W. Shoup; Robert Scobey

[57] ABSTRACT

A magnetic brush type developing device using a one-component system developing agent suitable for use with electrophotographic copying apparatus including a scraper having a magnetic wire disposed in close proximity to a developing sleeve serving as means for agitating and mixing a developing agent used for developing and a fresh supply of the developing agent fed to supplement the developing agent consumed by developing. The scraper includes a nonmagnetic plate provided with a plurality of stays in the form of a comb disposed on a side thereof facing the developing sleeve, and a magnetic wire mounted on the forward end of the stays and arranged in a magnetic field generated by a magnet disposed in the developing sleeve. The magnetic wire and the developing sleeve are spaced apart from each other by a predetermined gap.

27 Claims, 25 Drawing Figures

DEVELOPING DEVICE

FIELD OF THE INVENTION

This invention relates to a magnetic brush type developing device suitable for use with electrophotographic copying apparatus for developing with a one-component system developing agent electrostatic latent images formed on a photosensitive member or other latent image carrier in a predetermined process.

DESCRIPTION OF THE PRIOR ART

Figure 1:
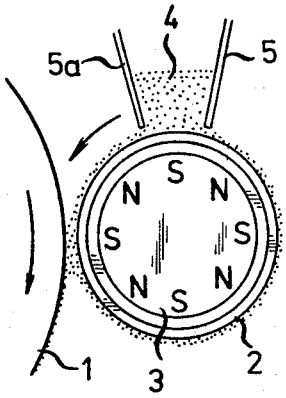
FIG.1 PRIOR ART
FIG. 1 is a sectional view schematically showing one example of a commonly used magnetic brush type developing device of the prior art.

An example of the commonly used developing device of the type described will be outlined by referring to FIG. 1. A magnet 3 having a plurality of magnetic poles is arranged in a nonmagnetic sleeve 2 located in predetermined spaced-apart relation to the surface of a photosensitive drum 1. Located above the sleeve 2 is a hopper 5 containing a one-component system toner 4 including a lower end disposed in close proximity to the surface of the sleeve 2 and spaced apart therefrom a predetermined distance. The hopper 5 includes a wall 5*a* disposed facing the photosensitive drum 1 having the function of a doctor for regulating the thickness of the layer of a developing agent.

The magnetic toner 4 fed through an opening in the lower portion of the hopper 5 on to the nonmagnetic sleeve 2 is attracted on the sleeve 2 by the magnetic attraction exerted by the magnet 3 to provide a magnetic brush which has its thickness regulated to a predetermined level by a gap formed in the lower end of the doctor 5*a*. The magnetic brush thus attracted on the sleeve 2 is conveyed toward the photosensitive drum 1. Upon reaching a position (developing position) in which it is closest to the photosensitive drum 1, the magnetic brush is transferred on to the latent image on the surface of the photosensitive drum 1 rotating in the direction of an arrow to develop same into a visible image. Following developing of the latent image into the visible image, the magnetic brush is further conveyed, and when it returns to the position on the sleeve in which it is juxtaposed against the hopper 5, a fresh supply of the developing agent is fed from the hopper 5 on to the sleeve 2.

In carrying out developing with a one-component system developing agent, selective developing takes place when there are variations in the grain size of the developing agent and the resistance thereof, so that the quality of the developed image shows changes with the progress of the developing run. When the one-component system developing agent used comprises a magnetic toner of high resistance, introduction of the electric charge on the photosensitive drum into the magnetic toner on the sleeve 2 results in the charge being held by the toner, so that forming of residual images and soiling of the background of the developed image occur. When the one-component system developing agent is a mixture of the magnetic toner of high resistance and an electrostatic buildup inducing and promoting agent, variation in the density of the solid regions of the image and the background of the image occur in the event agitation of the mixture and mixing and agitation of the toner supplementing the mixture are not carried out satisfactorily. To obviate this disadvantage, a scraper used with a developing device using a two-component system developing agent may be used for scraping the developing agent off the sleeve and returning same to the sleeve after performing mixing in another position. However, this suffers the disadvantage that the developing device becomes too large in size.

As agitation means for use with a developing device using a one-component system developing agent, it has hitherto been usual practice to use a nonmagnetic scraper formed as of phosphor bronze in thin sheets of about 0.15 mm thick formed with developing agent passing openings and developing agent blocking portions alternately arranged axially of the sleeve with a small gap being formed between the scraper and the sleeve for scraping the developing agent.

This type of scraper has, however, suffered disadvantages in that high precision finishes are required for obtaining a scraper of high linearity and a high degree of accuracy is required for mounting the scraper on the sleeve for mechanically scraping the toner off the sleeve, and that wear is caused on either the scraper or the sleeve because the edge of the former is pressed against the latter. When the scraper has a shape in which its forward end is merely cut perpendicular to the surface of the plate, toner blocking tends to occur between the forward end surface of the scraper and the sleeve. To avoid this trouble, it has hitherto been required to cut the forward end of the scraper in the form of a knife edge. It has also been necessary to decrease the thickness of the scraper to increase the accuracy with which the gap between the sleeve and scraper is maintained at a predetermined level. This has made handling of the scraper very difficult.

Figure 2:
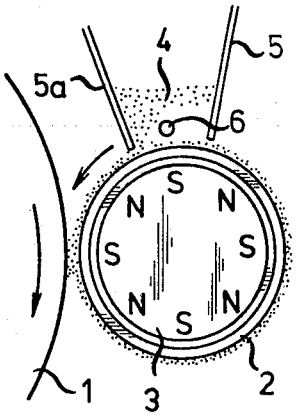
FIG.2 PRIOR ART
FIG. 2 is a sectional view of a magnetic brush type developing device using a magnetic wire serving as a developing agent scraping member.

In view of the aforesaid disadvantages suffered by the scrapers of various constructional forms of the prior art, we have made a proposal to provide a scraper easy to handle, high in durability, easy to manufacture and high in the results achieved in agitation of the developing agent, as disclosed in Japenese Patent Application Laid-Open No. Sho-53-132. We have also made a proposal to use a method of scraping a toner off the sleeve 2 not only mechanically but also magnetically by means of a magnetic wire 6 arranged in the hopper 5 in close proximity to the surface of the sleeve 2 axially of the sleeve 2, as shown in FIG. 2.

SUMMARY OF THE INVENTION

An object of the invention is to provide an improved magnetic brush type developing device using a one-component system developing agent comprising a scraper of construction, shape and material suitable for achieving excellent results in carrying the aforesaid proposals into practice.

Another object is to provide means for maintaining a gap between the magnetic wire at the forward end of the scraper and the developing sleeve at a predetermined level.

DETAILED DESCRIPTION OF THE PREFERRED EMBODIMENTS

Figure 3:
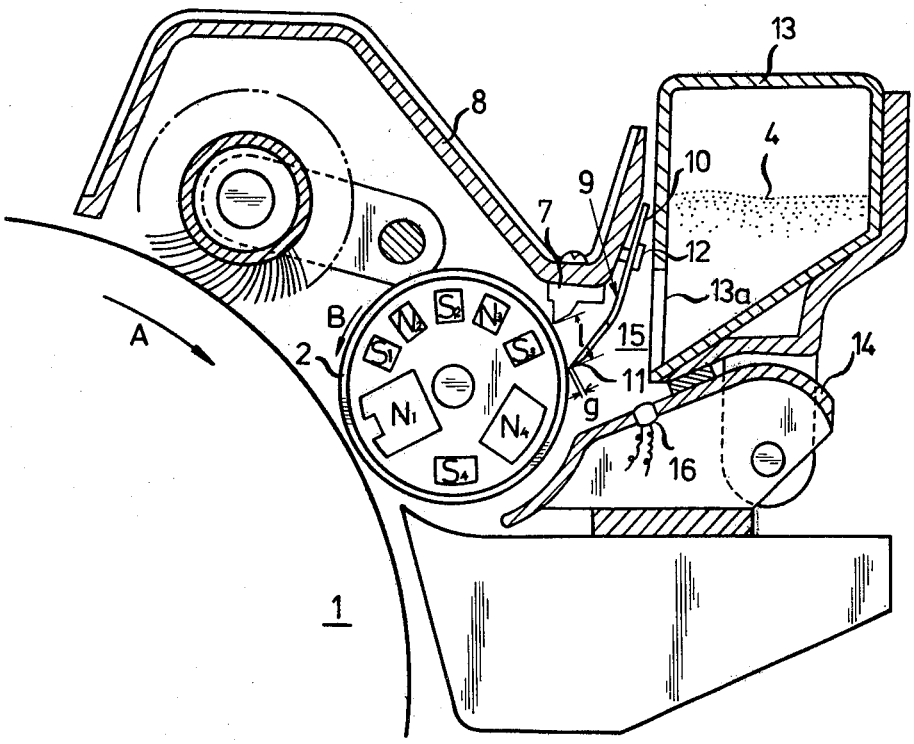
FIG. 3 is a sectional view of the magnetic brush type developing device comprising one embodiment of the invention.

Referring to FIG. 3 showing one embodiment of the invention, a developing sleeve 2 serving as developing agent holding means is arranged in close proximity to the outer peripheral surface of a photosensitive drum 1 serving as an electrostatic latent image carrier. The photosensitive drum 1 rotates in the direction of an arrow A and the sleeve 2 rotates in the direction of an arrow B. A magnet 3 having a plurality of magnetic poles N and S alternatively arranged circumferentially thereof is located in the sleeve 2 in fixed relation to a developing device housing 8 having secured thereto a doctor member 7 for regulating the thickness of the layer of a developing agent adjacent the developing sleeve 2 on a side thereof opposite the photosensitive drum 1. A stripper member or scraper 9 is arranged upstream of the doctor member 7 midway between a position in which developing is completed and a position in which a fresh supply of the developing agent is fed to the sleeve 2.

Figure 4:
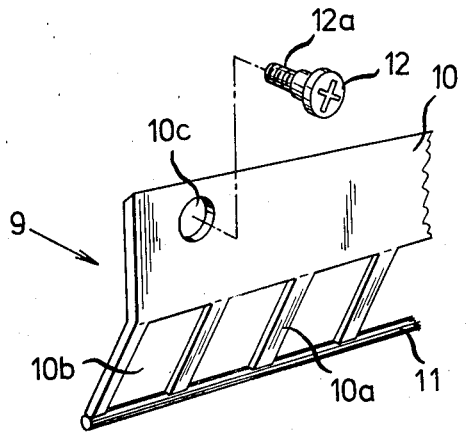
FIG. 4 is a perspective view of the scraper of the embodiment shown in FIG. 3.

Referring to FIG. 4, the scraper 9 comprises a wire holding portion 10 of a nonmagnetic plate form of considerable rigidity formed of phosphor bronze, brass, stainless steel, etc., and having a thickness of 0.5–2.0 mm with a plurality of stays 10*a* in the form of a comb located on a side thereof facing the sleeve 2, and a magnetic wire 11, such as piano wire, soft iron wire, stainless steel wire, etc., attached to the forward end of the stays 10*a*. The scraper 9 of the aforesaid construction is formed with a plurality of toner passing openings 10*b* arranged axially of the sleeve 2 and defined by the body of the wire holding portion 10, stays 10*a* and magnetic wire 11.

Figure 5:
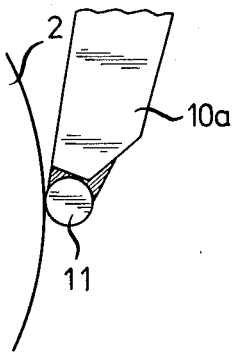
FIG. 5 is a sectional view, on an enlarged scale, of the forward end portion of the scraper shown in FIG. 4.

As shown in FIG. 5, the stays 10*a* have their forward end cut in wedge form in such a manner that its thickness is substantially equal to the diameter of the wire 11, and the wire 11 is joined thereto by brazing bonding or other suitable known means.

The scraper 9 of the aforesaid construction is mounted on the housing 8 in such a manner that, as shown in FIG. 4, a stepped screw 12 is inserted in each of loose openings 10*c* of a suitable number formed in the body of the wire holding portion 10 and threadably engaged in a threaded portion 12*a* in one of the threaded openings formed in the housing 8 with suitable play on the surface of the wire holding portion 10 so that the magnetic wire 11 is located in a magnetic field formed by the magnet 3 in the sleeve 2.

As shown in FIG. 3, a cartridge 13 containing a developing agent 4 for supplying the developing agent to the sleeve 2 is detachably attached to the housing 8 adjacent the scraper 9. The cartridge 13 is formed with an opening 13*a* on a side thereof facing the sleeve 2 when it is set in a predetermined position on the housing 8 and has a bottom which is inclined to enable the developing agent to flow downwardly by its own weight. The angle of inclination of the bottom is usually over 30 degrees.

Auxiliary developing agent supply means 14 is mounted in a manner to extend contiguously from the inclined bottom of the cartridge 13 to below the sleeve 2 and has an upper surface inclined such that the developing agent 4 can flow downwardly thereon by its own weight and the magnetic force of the magnet 3. After coming close to the sleeve 2, the upper surface of the auxiliary developing agent supply means 14 extends to the vicinity of the lower end of the sleeve 2 in a manner to enclose same.

The auxiliary developing agent supply means 14, cartridge 3, sleeve 2, and doctor member 7, define a developing agent storing space 15. Thus the scraper 9 is located in the developing agent storing space 15. The auxiliary developing agent supply means 14 is provided on its upper surface facing the space 15 with means 16 for sensing the presence or absence of the developing agent.

The developing device according to the invention is constructed as aforesaid. The developing agent 4 in the cartridge 13 flows downwardly by its own weight on the inclined bottom thereof and through the opening 13*a* to the auxiliary developing agent supply means 14 from which it is passed either directly or together with the recovered developing agent following developing or cleaning to the sleeve 2 where it is attracted to the surface thereof by the magnetic attraction of the magnet 3 in the sleeve 2.

Depletion of the developing agent in the cartridge 13 and storing space 15 is sensed by the sensing means 16 which produces a suitable signal to warn the operator, thereby enabling the developing agent to be supplemented at opportune times.

Figure 6:
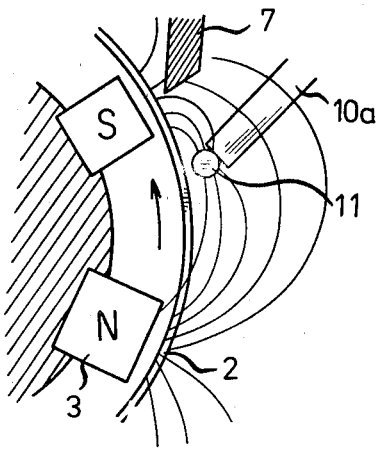
FIGS. 6–9 are views in explanation of the operation of the scraper according to the invention.
Figure 7:
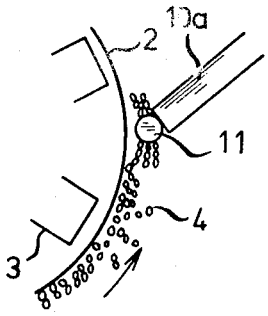

Referring to FIG. 6, lines of magnetic force are generated by the magnet 3 in the sleeve 2 in such a manner that they are concentrated in the vicinity of the magnetic wire 11 located close to the surface of the sleeve 2. Thus the developing agent 4 attracted to the surface of the sleeve 2 by the magnet 3 is attracted to the magnetic wire 11 as the sleeve 2 rotating in the direction of an arrow approaches the magnetic wire 11, so that the developing agent 4 is kept from being conveyed by the sleeve 2.

Figure 8:
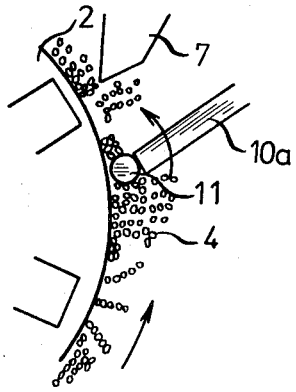

As the volume of the developing agent 4 attracted by the magnetic wire 11 exceeds a level that can be attracted and held by the magnetic wire 11, no more developing agent is attracted to the magnetic wire 11 and, as shown in FIG. 8, the developing agent 4 leaps over the magnetic wire 11 and passes through the opening 10*b* formed in the scraper 9, to be attracted to the surface of the sleeve 2 and conveyed thereby. In this way, the developing agent used for carrying out developing is agitated as it is conveyed.

Figure 9:
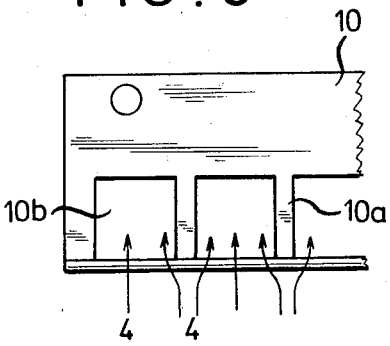

As the developing agent 4 passes through the openings 10*b* formed in the scraper 9, the developing agent 4 impinging; on the stays 10*a* is, as shown in FIG. 9, scattered to right and left and agitated in a direction normal to the direction in which it is conveyed. Thus the developing agent is agitated in four directions so that it is uniformly mixed and has its layer regulated to a predetermined thickness by the doctor member 7 before being sent to the developing station.

The wire holding portion 10 being formed of nonmagnetic material, the developing agent 4 is kept from being attracted to the body of the holding member 10 or the stays 10*a* and capable of flowing smoothly. Because the wire 11 alone is formed of magnetic material of all the parts of the scraper 9, the lines of magnetic force produced are of the desired shape as shown in FIG. 6. Should the scraper 9 be formed entirely of magnetic material, it would be attracted to the magnet 3 in the sleeve 2 and difficult to handle. Since the scraper 9 according to the invention has only the wire 11 thereof formed of magnetic material, this trouble can be eliminated.

As described hereinabove, the scraper 9 is secured by stepped screws 12 to the housing 8 with play, so that it is brought into contact with the sleeve 2 by a composite force of powder pressure of the developing agent acting upon the scraper means, the weight of said scraper meansl itself and the magnetic force of the magnet 3 attracting the wire 11, and a gap is defined between the sleeve 2 and wire 1 without spoiling the linearity of the letter.

When this gap is too large in size, it is impossible for the magnetic wire 11 to prevent the transfer of the developing agent by the sleeve 2 and the developing agent 4 attracted to the sleeve 2 passes under the wire 11, thereby making it impossible to agitate the developing agent. Thus it is necessary that the gap g between the wire 11 and sleeve 2 be kept at a suitable size.

Figure 10:
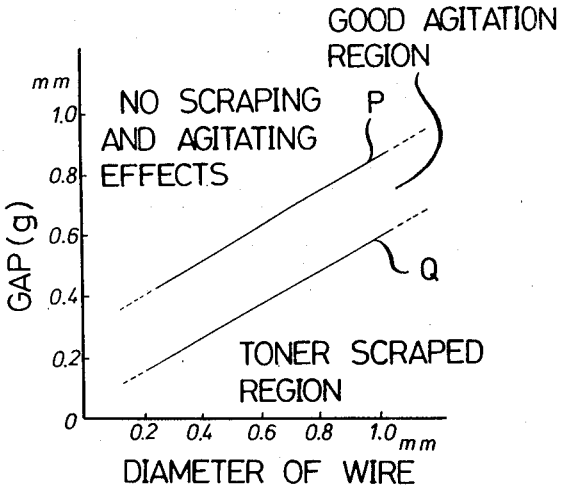
FIG. 10 is a view showing the influences exerted by the diameter of the magnetic wire of the scraper and the gap between the wire and the developing sleeve on the agitation and scraping of the developing agent.
Figure 13:
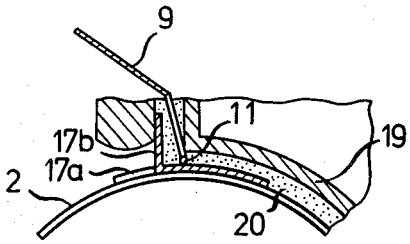
FIG. 13 is a sectional view of the spacer shown in FIG. 12.

Experiments were conducted on the influences exerted by the diameter of the magnetic wire 11 of the scraper 9 and the size of the gap g between the sleeve 2 and wire 11 on the results achieved in agitation and scraping of the developing agent. The results obtained are shown in FIG. 10 in which the abscissa represents the diameter of the wire 11 and the ordinate indicates the gap g. A region above a line P is a region in which no scraping and agitation effects are achieved; a region below the line Q is a toner scraped region; and a region between lines P and Q is a region in which agitation can be effected with good results. In the figure, it will be seen that scraping and agitating can be carried out with good results when the wire 11 has a diameter of 0.4 mm and the gap g is below 0.5 mm and when the wire 11 has a diameter of 0.6 mm and the gap g is below 0.6 mm. When the wire 11 has a diameter of 1.0 mm, good results can be achieved if the gap g is below 0.9 mm, as shown in FIG. 13. However, when the diameter of the wire 11 increases, the volume of the developing agent 4 arrested thereby also increases and this, combined with the arresting action of the doctor member 7, causes overflowing of the developing agent 4 in the storing space 15 through the end of the auxiliary developing agent supply means 14 and the mounting portion of the scraper 9 which soils the machine. For practical purposes, the wire 11 preferably has a diameter in the range between 0.2 and 0.6 mm.

In the embodiment shown and described hereinabove, the wire 11 is not in direct contact with the surface of the sleeve 2 and the developing agent interposed between the wire 11 and sleeve 2 has a slight degree of powder pressure (about 60 g in the entire scraper 9). Thus the problems are raised with regard to the scratching of the surface of the sleeve 2 by the scraper 9, the toner blocking between the sleeve 2 and scraper 9, maintenance of the gap g in a range suitable for achieving the agitating effects, and the fatigue of the developing agent due to the heat of friction, etc. The arrangement whereby the wire 11 is attached to the stays 10*a* cut at the forward end in wedge form to a size substantially equal in thickness to the diameter of the wire 11 keeps other parts of the scraper 9 than the magnetic wire 11 from coming into contact with the sleeve 2.

Figure 11:
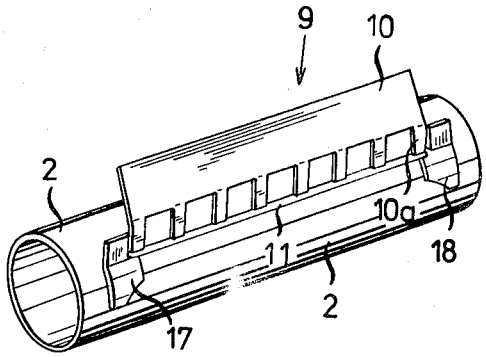
FIG. 11 is a perspective view of one example of the arrangement of the spacers for keeping the magnetic wire at the forward end of the scraper in a predetermined spaced-apart relation to the developing sleeve.
Figure 12:
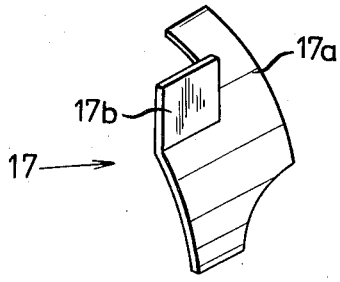
FIG. 12 is a perspective view of the spacer.

If the wire 11 can be formed to have a perfect linearity, it would be possible to bring same into contact with the sleeve 2 in its entirety. However, preferably a gap of a suitable size is provided as described hereinabove and the wire and the sleeve are brought out of direct contact with each other. This is conducive to elimination of injury and wear that might otherwise be caused by direct contact between them, thereby avoiding deterioration of the image produced by developing. Maintenance of the gap of a suitable size can be achieved by using spacers 17 and 18 shown in FIG. 11 which are located on opposite ends of the magnetic wire 11 between the forward end of the scraper 9 and the surface of the developing sleeve 2. The spacers 17 and 18 which are formed of nonmagnetic resilient material, such as phosphor bronze, and have a thickness in the range between 0.1 and 0.3 mm are symmetrically arranged at the opposite ends of the wire 11. FIG. 12 shows the spacer 17 on an enlarged scale. As shown, the spacer 17 (18) is generally curved to conform to the curvature of the surface of the sleeve 2 and includes a vertical portion 17*b* formed by upwardly bending an upper part of one-half portion produced by vertically splitting the spacer in the middle into two halves, and a curved portion 17*a* constituting the rest of the spacer. As shown in FIG. 13, the spacer 17 is inserted below a resilient guide seal 20 arranged between a projection 19 on a housing side plate and the developing sleeve 2 or between the seal 20 and sleeve 2, and kept from rotating as the vertical portion 17*b* abuts against the projection 19 on the housing side plate. The other spacer 18 is also attached in the same manner as described by referring to the spacer 17. Thus the two spacers 17 and 18 are detachably attached to the sleeve 2 in a portion thereof corresponding to non-image regions of the surface thereof.

The magnetic wire 11 at the forward end of the scraper 9 can have structural stability when its opposite ends are supported at the stays 10*a* by the spacers 17 and 18. However, the wire 11 may be extended from the stays 10*a* and ring-shaped spacers may be attached to the extension. Also, the spacers may be attached by projecting the wire 11 from the stays 10*a* or projecting the stays 10*a* farther than other parts, or projecting portions of the sleeve 2 in contact with the opposite ends of the wire 11 extending farther than other parts of the sleeve 2. Alternatively the spacer 9 or sleeve 2 itself may be shaped as described hereinabove.

Figure 14:
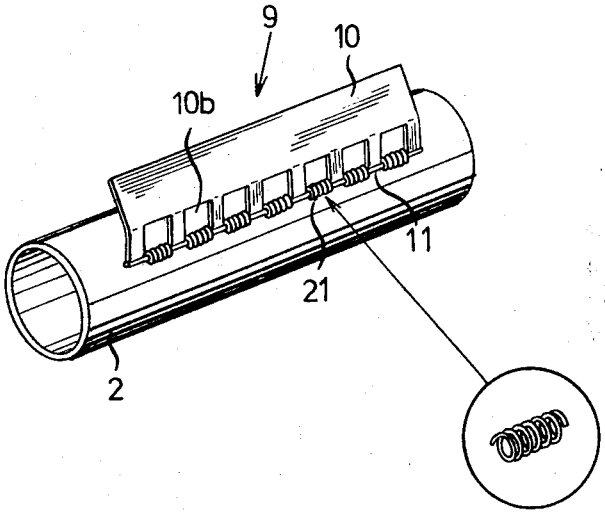
FIGS. 14 and 15 are perspective views of modifications of the spacer.
Figure 15:
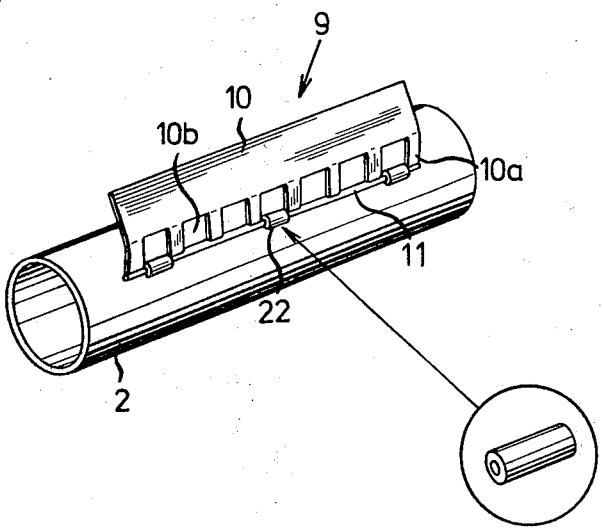

As shown in FIGS. 14 and 15, the spacers may be attached to the magnetic wire 11 at the forward end of the spacer 9 in positions corresponding to the windows 10*a* for rotation about the magnetic wire 11. The spacers 21 shown in FIG. 14 each comprise a spring coil of nonmagnetic material having a diameter in the range between 0.15 and 3.0 mm. Each spacer 21 preferably has its opposite ends closed endlessly to avoid dislodging from the position during rotation. The spacers 22 shown in FIG. 15 are each in the form of a tube of nonmagnetic material with a thickness in the range between 0.15 and 0.3 mm. The spacers 21 and 22 may be only one in number if it is desired to minimize the number. In this case, the single spacer may be mounted on the central portion of the scraper 9.

By using the spacers as aforesaid, it is possible to avoid damage or wear that might otherwise be caused on the scraper 9 and sleeve 2 and to produce images of high quality so long as the scraper 9 has linearity and rigidity of a certain degree, because the forward end of the scraper 9 is not in contact with the surface of the sleeve 2. By rendering the spacers detachable, it is possible to replace the old spacers by new ones to keep the gap of a predetermined size to be maintained at all times. When the spacers are arranged in non-image regions on the sleeve, no influences are exerted on the quality of the developed image even if congealing of the toner occurs on the sleeve.

Figure 16:
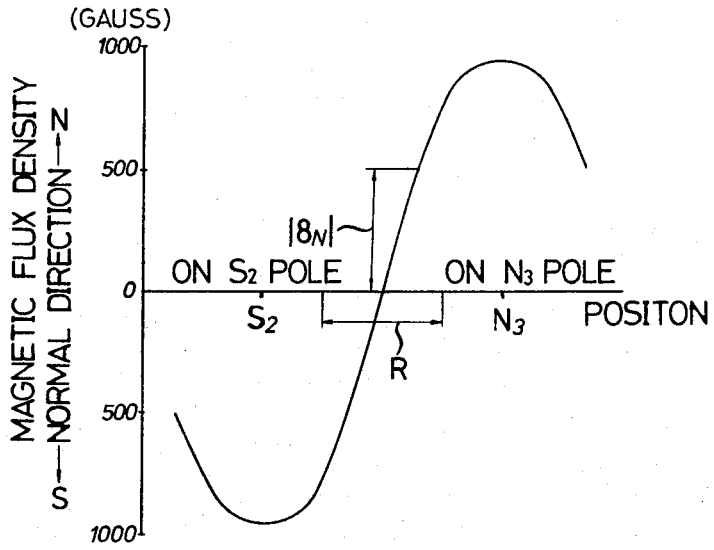
FIGS. 16 and 17 are diagrammatic representations of the distribution of the magnetic flux in directions normal to and tangential to the portion of the scraper at the forward end thereof at which the magnetic wire is mounted, respectively.
Figure 17:
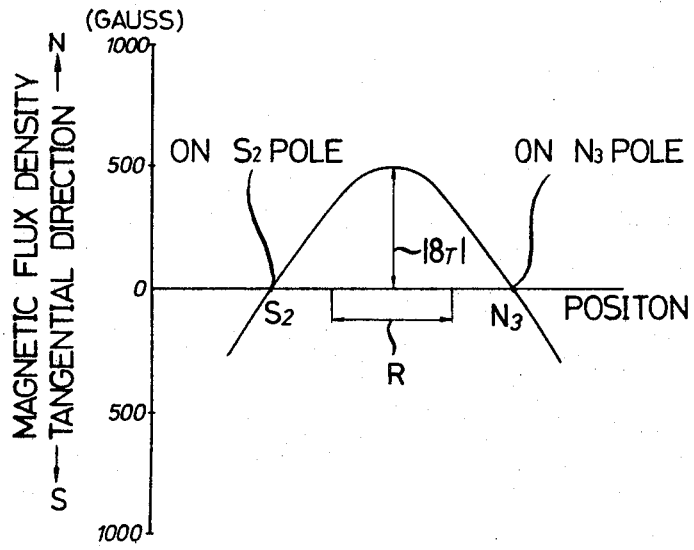

When the wire 11 is kept in contact with the sleeve 2, it is necessary that the wire 11 be formed of material of sufficiently high hardness and resilience to avoid deformation that might be caused by the powder pressure of the toner or normal handling of the device during service, in order that changes in the size of the gap between the wire and sleeve that might occur with time due to the powder pressure applied by the toner may be avoided. As material for producing the wire, piano wire, stainless steel wire, hard steel wire, etc., may be used. FIGS. 16 and 17 show the relation between the position in which the magnetic wire 11 at the forward end of the scraper 9 is located and the magnetic flux density of a magnetic field. In FIG. 16, one example is shown of the magnetic flux distribution in a normal direction on the surface of the sleeve 2 in the vicinity of the magnetic poles S2 and N3, and in FIG. 17, one example is shown of the magnetic flux distribution in a tangential direction on the moving side of the sleeve. The data shown in FIGS. 16 and 17 have been obtained while no developing agent and scraper are present on the sleeve, and the magnetic flux density B on the sleeve is expressed as a composite vector of the normal magnetic flux density $B_N$ and the tangential magnetic flux density $B_T$ or $$B = \sqrt{B\frac{2}{N} + B\frac{2}{T}} > 0.$$

The forward end of the scraper 9 at which the magnetic wire 11 is located preferably has a magnetic flux density in a range R of over 100 G.

In the embodiment of the construction shown in FIG. 3, if the distance *l* between the doctor member 7 and the wire 11 of the scraper 9 is not suitable, the developing agent scraped by the scraper 9 has its thickness regulated by the doctor member 7 and delivered before it is not thoroughly agitated, so that it lacks uniformity in character. It is necessary that the distance *l* have a suitable value.

Figure 18:
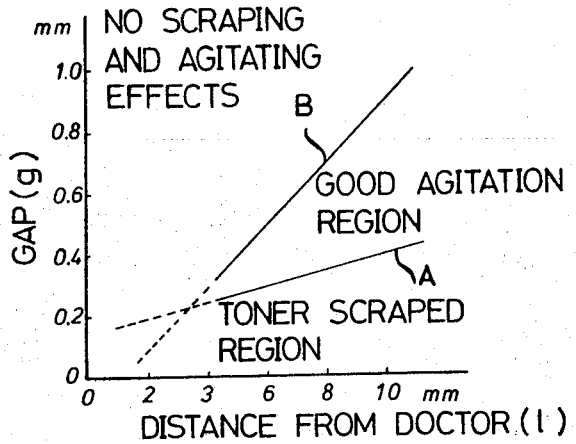
FIG. 18 is a diagrammatic representation of the influences exerted by the gap between the doctor and the magnetic wire at the forward end of the scraper and the gap between the magnetic wire and the developing sleeve on the agitation and scraping of the developing agent.

FIG. 18 shows the influences exerted by the distance *l* between the scraper 9 and the doctor member 7 and the gap g between the sleeve 2 and the wire 11 on the agitation and scraping of the developing agent by the scraper 9 when a piano wire of a diameter of 0.6 mm is used as the magnetic wire 11. A region above a straight line $A_B$ is a region in which agitation is carried out satisfactorily, and a region below a straight line A is a region in which the toner is scraped. In the figure, it will be seen that by arranging the scraper 9 to be spaced from the doctor member 7 at least over 3 mm and providing a gap of the size in the range interposed between the two straight lines A and B between the sleeve 2 and wire 11, it is possible to achieve excellent agitation effects.

The results of experiments show that the larger the diameter of the magnetic wire 11, the closer becomes the intersection of the two straight lines A and B to zero, and that when the diameter is 0.9 mm, it becomes zero. However, if the scraper 9 and the doctor member 7 are located in the same position, trouble occurs because the developing agent is delivered by the doctor member 7 to the developing station before being thoroughly agitated even if the developing agent is scraped off. Thus it is necessary that the distance *l* be at least 3 mm.

When the diameter of the magnetic wire becomes smaller, the two straight lines A and B become gradually parallel to each other, until parallelism is attained when the diameter is 0.4 mm. Stated differently, good agitation of the developing agent can be obtained no matter what the value of *l* may be.

From the foregoing, it will be understood that the distance between the doctor member 7 and the wire 11 of the scraper 9 has only to be over 3 mm regardless of the diameter of the wire 11.

The diameter of the wire 11 may be in the range between 0.1 and 2.0 mm to accomplish the object of scraping off the developing agent. However, when the diameter of the wire 11 is too large, the developing agent may be arrested too strongly and leaks of the developing agent through the gap in the housing beneath the sleeve may soil the parts of the apparatus in the vicinity of the developing device. However, when the diameter is too small, a problem will be raised with regard to the handling of the wire. Thus for practical purposes, the diameter of the wire is preferably in the range between 0.2 and 0.6 mm.

Figure 19:
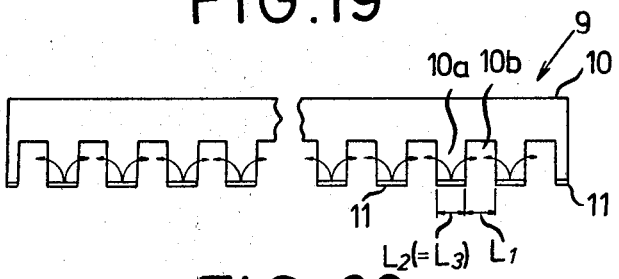
FIGS. 19–21 are front views of modifications of the magnetic wire of the scraper in the form of a plurality of short segments of magnetic wire obtained by cutting a single magnetic wire.
Figure 20:
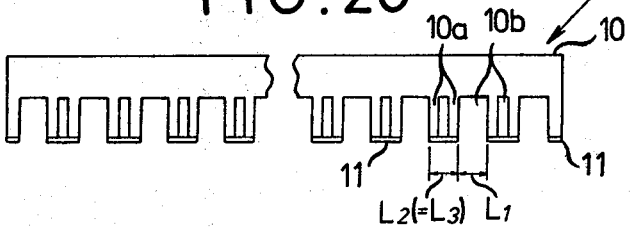

In the embodiment shown and described hereinabove, the magnetic wire attached to the forward end of the scraper comprises a single wire continuously extending along the length of the scraper. However, the invention is not limited to this specific form of the magnetic wire, and the magnetic wire may be composed of a plurality of short wire segments attached to the stays at regular intervals in alignment with one another. FIG. 19 shows an example in which a magnetic wire segment 11 of a length $L_2$ equal to the length $L_3$ of the stays is attached to each of the stays 10*a* of the scraper 9. FIG. 20 shows an example in which a magnetic wire segment 11 is attached to the adjacent two stays 10*a*, and FIG. 21 shows an example in which a magnetic wire segment 11 of a length larger than the length of the stays 10*a* is attached to each of the stays 10 of the scraper 9 in such a manner that opposite end portions of the magnetic wire segment 11 extend outwardly of the ends of the stay 10*a* in equal amount.

In the various constructional forms of the scraper described hereinabove, the essential length $L_1$ of the developing agent passing portions 10*b* of the scraper 9 or the spacing between the adjacent magnetic wire segments 11 at the forward end of the scraper 9 and the length $L_2$ of the developing agent arresting portions 10*a* of the spacer 9 or the length of each magnetic wire segment 11 at the forward end of the scraper 9 exert great influences on developing agent agitation efficiency. More specifically, when the developing agent passing portions 10*b* are too long, the toner passes therethrough in the central portion without being thoroughly mixed. Conversely when the developing agent arresting portions 10*a* are too long, the toner congeals at the arresting portions or renders the operation of the toner member unstable. Thus the ratio of the length of the developing agent passing portion to that of the developing agent arresting portion $L_1$:$L_2$ is preferably between 2:3 and 3:2.

Figure 21:
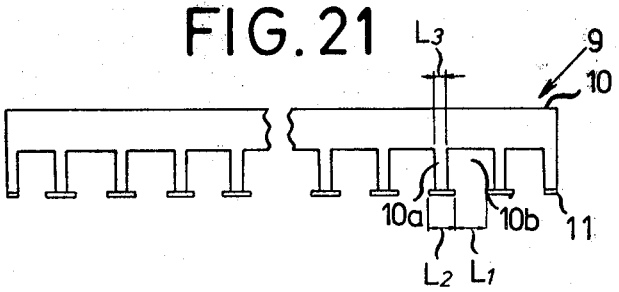

With the scraper 9 having the magnetic wire 11 made up of wire segments as shown in FIGS. 19–21, the gap between the magnetic wire 11 and the sleeve 2 is also preferably below 0.6 mm in size as is the case with the corresponding gap between the magnetic gap of single wire construction and the sleeve 2. To maintain the gap in a predetermined range, the spacers shown in FIGS. 11–13 may be attached to the outer forward portion at opposite ends of the scraper 9, and the spacers of coil or tube shape shown in FIGS. 14 and 15 may be attached to the forward end of the wire segments in the intermediate portion.

The magnetic flux density at the forward end of the scraper 9 at which the magnetic wire 11 is attached is preferably over 100 G when the magnetic wire 11 is composed of short wire segments as is the case with the magnetic wire 11 comprising a single wire, in a condition in which the developing agent and the scraper do not exist.

Figure 22:
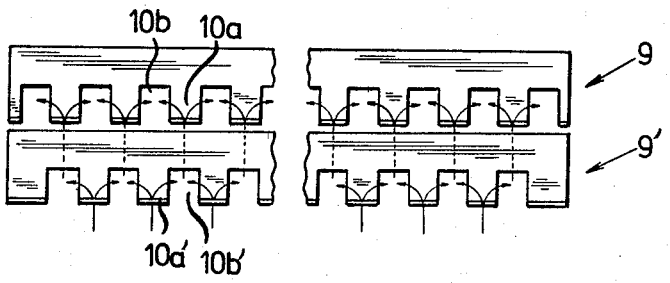
FIG. 22 is a front view of a modification of the scraper including two members arranged in two layers.

In order to increase the effects achieved by the scraper 9, a plurality of scrapers may be provided. When this is the case, the scrapers may be arranged in such a manner that, as shown in FIG. 22, each of the developing agent passing portions 10*b* of the rear scraper 9 is indexed with each of the developing agent arresting portions 10*a* of the front scraper 9', and each of the developing agent arresting portions 10*a* of the rear scraper 9 is indexed with each of the developing agent passing portions 10*b* of the front scraper 9'. By this arrangement, the developing agent passing through the developing agent passing portions 10*b* of the front scraper 9' is scraped or diverted to left and right, thereby enabling increased agitation effects to be achieved.

Figure 23:
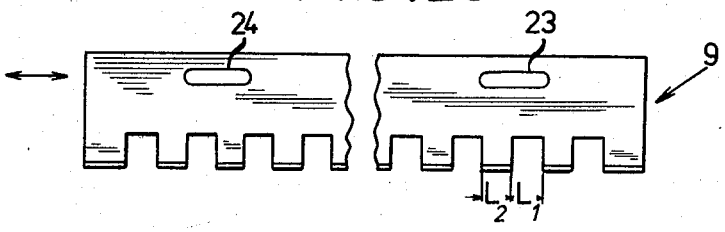
FIG. 23 is a front view of a modification of the scraper which is movable in reciprocatory movement axially of the developing sleeve.

In the invention, the agitation efficiency can be further increased by moving the scraper in reciprocatory movement axially of the developing sleeve. For example, as shown in FIG. 23, slots 23 and 24 may be formed in the scraper 9 in such a manner that each slot extends lengthwise of the scraper 9 from one end of the developing agent arresting portion to the other end of the adjacent developing agent passing portion or a distance equal to the length $L_2$ of the arresting portion plus the length $L_1$ of the passing portion. The slots 23 and 24 each receive therein one of pins secured to the doctor member 7 or other fixed part for guiding the movement of the scraper 9 in reciprocatory movement effected by known means. Since the scraper 9 is arranged to have its forward end spaced apart from the sleeve 2, the scraper can be moved in reciprocatory movement without running the risk of wear being caused thereon due to frictional dragging of the scraper on the sleeve.

Figure 24:
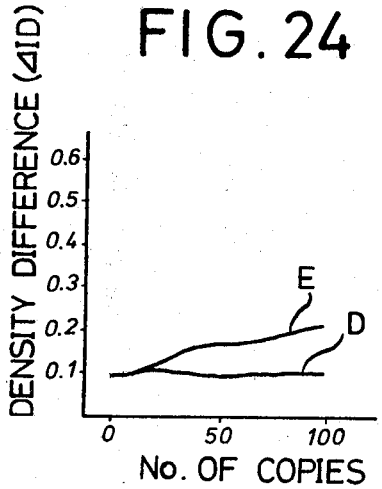
FIG. 24 is a diagrammatic representation of the results of experiments conducted to show the effects achieved by the modification of the scraper shown in FIG. 23.
Figure 25:
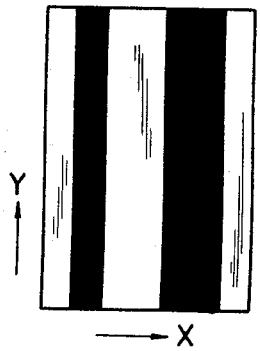
FIG. 25 is a view of the image pattern used in the experiments whose results are shown in FIG. 24.

FIG. 24 shows the results achieved by the reciprocatory movement of the scraper shown in FIG. 21. The developing agent used in the experiments comprised 85 wt% of a high resistance magnetic toner and 15 wt% of an electrostatic buildup inducing agent, and a document used in the experiments FIG. 25 had two solid black strips of widths 20 and 40 mm respectively extending in the direction of an arrow Y parallel to each other. FIG. 24 shows a density variation ΔID of solid black strips in the direction of an arrow X in relation to the number of duplicates produced. The results of the experiment show that the density variation for the solid black strip of the width 20 mm is rather small as represented by a curve D irrespective of whether or not the scraper 9 is moved, and that destiny variation for the solid black strip of the width 40 mm is rather small as represented by the curve D when the scraper 9 was moved but becomes large at the numbers of duplicates produced increases as represented by a curve E when the scraper 9 was not moved. As indicated by the results of the experiments, the larger the area of the solid black strips, the greater is the effect achieved in moving the scraper 9 in reciprocatory movement.

From the foregoing description, it will be appreciated that when a developing agent of a compound type single-component system comprising a high resistance magnetic toner and an electrostatic buildup inducing agent mixed together is used for developing a latent image into a visible image, the present invention enables good agitation and mixing of a toner returned to the storing section after used for developing and a toner freshly supplied to the storing section to be obtained, so that the developing agent of uniform composition can be supplied to the developing station. This is conducive to improved quality of the developed images and prolonged service life of the developing agent agitation members such as the scraper, sleeve and the like.

What is claimed is:

1. In a magnetic brush type developing device comprising:

developing agent holding means rotatably supported and spaced apart a small distance from a latent image carrier;

means for feeding a one-component system developing agent to said developing agent holding means;

means for regulating the thickness of a layer of the developing agent fed to said developing agent holding means;

magnetic field generating means mounted on said developing agent holding means for carrying out developing by bringing the regulated layer of the developing agent into face-to-face relation to the latent image carrier; and scraper means provided with a magnetic member for scraping the developing agent off the developing agent holding means after completion of developing and before a fresh supply of developing agent is fed to the developing agent holding means; the improvement comprising:

nonmagnetic plate formed with a plurality of stays of comb-shape mounted on said scraper means on a side thereof juxtaposed against said developing agent holding means, said plurality of stays having attached to the forward end thereof a magnetic wire arranged to be located in a magnetic field formed by a magnet located in said developing agent holding means.

2. A magnetic brush type developing device as claimed in claim 1, wherein said scraper means is uniformly in contact with said developing agent holding means.

3. A magnetic brush type developing device as claimed in claim 1, wherein said scraper means is at least partially out of contact with said developing agent holding means.

4. A magnetic brush type developing device as claimed in claim 1, wherein said scraper means is totally out of contact with said developing agent holding means.

5. A magnetic brush type developing device as claimed in claim 2 or 3, wherein said scraper means is constructed such that a portion thereof in contact with said developing agent holding means is occupied by said magnetic wire.

6. A magnetic brush type developing device as claimed in claim 5, wherein each of said stays is cut in the form of a wedge of a thickness substantially equal to the diameter of said magnetic wire for attaching the magnetic wire to said forward end.

7. A magnetic brush type developing device as claimed in claim 3, wherein said magnetic wire has a diameter in the range between 0.1 and 1.0 mm, and said scraper means is spaced apart from said developing agent holding means a distance less than 0.9 mm.

8. A magnetic brush type developing device as claimed in claim 1, wherein said magnetic wire has a diameter in the range between 0.2 and 0.6 mm.

9. A magnetic brush type developing device as claimed in claim 3, wherein said scraper means is mounted with play on a fixed part comprising a housing of the developing agent as by stepped screws, so that the scraper means is brought into contact at its forward end with said developing agent holding means by a composite force of powder pressure of the developing agent acting upon the scraper means, the weight of said scraper means itself and the magnetic force of the magnet located in said developing agent holding means attracting said magnetic wire.

10. A magnetic brush type developing device as claimed in claim 4, wherein said scraper means is mounted with play on a fixed part comprising a housing of the developing device as by stepped screws, and further comprising a plurality of spacers inserted between said magnetic wire and said developing agent holding means, so that the scraper means is spaced apart from said developing agent holding means by a gap of a predetermined size when moved by its own weight.

11. A magnetic brush type developing device as claimed in claim 10, wherein said plurality of spacers are formed of nonmagnetic material.

12. A mangetic brush type developing device as claimed in claim 10, wherein said plurality of spacers are located in positions corresponding to nonimage regions of said developing agent holding means.

13. A magnetic brush type developing device as claimed in claim 10, wherein said plurality of spacers are formed of resilient material.

14. A magnetic brush type developing device as claimed in claim 10, wherein said plurality of spacers are formed in a unitary structure and detachably attached to the developing device.

15. A magnetic brush type developing device as claimed in claim 10, wherein said plurality of spacers are formed integrally with said scraper means.

16. A magnetic brush type developing device as claimed in claim 10, wherein said plurality of spacers are integral with said developing agent holding means.

17. A magnetic brush type developing device as claimed in claim 10, wherein said scraper means is mounted for movement on the developing device.

18. A magnetic brush type developing device as claimed in claim 10, wherein said plurality of spacers are mounted on the magnetic wire at the forward end of said scraper means for rotation thereabout.

19. A magnetic brush type developing device as claimed in claim 18, wherein said plurality of spacers are in coil form.

20. A magnetic brush type developing device as claimed in claim 19, wherein said plurality of spacers in coil form are endlessly closed at opposite ends thereof.

21. A magnetic brush type developing device as claimed in claim 18, wherein said plurality of spacers are in tubular form.

22. A magnetic brush type developing device as claimed in claim 1, wherein said magnetic wire on said scraper means is formed of material of hardness and resilience such that it undergoes no deformation when pressure is applied thereto by the developing agent when it is handled in the usual manner.

23. A magnetic brush type developing device as claimed in claim 1, wherein said magnetic wire on said scraper means has a diameter in the range between 0.1 and 2.0 mm and is spaced apart from said means for regulating the thickness of the developing agent fed to said developing agent holding means by at least over 3 mm in the upstream direction with respect to the direction of rotation of said developing agent holding means.

24. A magnetic brush type developing device as claimed in claim 23, wherein said magnetic wire on said scraper means has a diameter in the range between 0.2 and 0.6 mm.

25. A magnetic brush type developing device as claimed in claim 1, further comprising developing agent feeding means located adjacent said developing agent holding means on a side thereof opposite said latent image carrier, said developing agent feeding means containing the developing agent and inclined at its bottom to allow the developing agent to flow downwardly by its own weight and formed with an opening at a wall surface facing said developing agent holding means, and auxiliary developing agent feeding means inclined such as to allow the developing agent fed from said developing agent feeding means to flow downwardly by its own weight and by the magnetic force of said developing agent holding means, said developing agent feeding means and said auxiliary magnetic agent feeding means being located in the indicated order so that said scraper means is located in a region defined by said developing agent feeding means, said auxiliary developing agent feeding means and said means for regulating the thickness of the layer of the magnetic agent fed to said magnetic agent holding means.

26. A magnetic brush type developing device as claimed in claim 25, further comprising means for sensing the presence or absence of the developing agent located on the surface of said auxiliary developing agent feeding means.

27. A magnetic brush type developing device as claimed in claim 1, wherein a magnetic field in which said magentic wire at the forward end of said scraper means is located has a magnetic flux density of over 100 G when it is expressed as a composite vector of the magnetic flux density on the surface of said developing agent holding means in a normal direction and the magnetic flux density on the surface of said developing agent holding means in a moving side tangential direction with no magnetic toner and no scraper means being present.

* * * * *

UNITED STATES PATENT AND TRADEMARK OFFICE

CERTIFICATE OF CORRECTION

PATENT NO. : 4,406,536

DATED : September 27, 1983

INVENTOR(S) : KOHJI SUZUKI, TOSHIO KANEKO, HAJIME OYAMA and SHIGEKAZU ENOKI

It is certified that error appears in the above-identified patent and that said Letters Patent is hereby corrected as shown below:

Add the following claims 28 and 29:

--28. A magnetic brush type developing device as claimed in claim 5, wherein said magnetic wire has a diameter in the range between 0.2 and 0.6 mm.

29. A magnetic brush type developing device as claimed in claim 6, wherein said magnetic wire has a diameter in the range between 0.2 and 0.6 mm.--

On the title page "27 Claims" should read -- 29 Claims --.

Signed and Sealed this

*Fifth* Day of *June 1984*

[SEAL]

*Attest:*

GERALD J. MOSSINGHOFF

*Attesting Officer*

*Commissioner of Patents and Trademarks*